US008049089B2

(12) United States Patent
Stevens

(10) Patent No.: US 8,049,089 B2
(45) Date of Patent: Nov. 1, 2011

(54) KEYBOARD PERCUSSION INSTRUMENT AND DAMPENING SYSTEM FOR USE THEREWITH

(76) Inventor: Leigh Howard Stevens, Neptune, NJ (US)

( * ) Notice: Subject to any disclaimer, the term of this patent is extended or adjusted under 35 U.S.C. 154(b) by 0 days.

(21) Appl. No.: 12/612,050

(22) Filed: Nov. 4, 2009

(65) Prior Publication Data

US 2010/0107852 A1 May 6, 2010

Related U.S. Application Data

(60) Provisional application No. 61/111,161, filed on Nov. 4, 2008.

(51) Int. Cl.
*G10D 13/08* (2006.01)

(52) U.S. Cl. ..... 84/402; 84/403; 84/410

(58) Field of Classification Search ..... 84/402, 84/403, 410

See application file for complete search history.

(56) References Cited

U.S. PATENT DOCUMENTS

| | | | | | |
|---|---|---|---|---|---|
| 1,763,526 | A | * | 6/1930 | Jones | 84/403 |
| 1,801,422 | A | * | 4/1931 | Gladstone | 84/410 |
| 1,807,057 | A | | 5/1931 | Bowers | |
| 1,843,553 | A | * | 2/1932 | Gladstone | 84/403 |
| 1,902,614 | A | * | 3/1933 | Bower | 84/410 |
| 2,133,712 | A | * | 10/1938 | Musser | 84/403 |
| 2,194,545 | A | * | 3/1940 | Firestone | 84/403 |
| 2,556,342 | A | | 6/1951 | Dickran | |
| 2,795,162 | A | | 6/1957 | Eash | |
| 3,138,986 | A | * | 6/1964 | Musser | 84/410 |
| 3,649,737 | A | | 3/1972 | Jespersen | |
| 3,742,984 | A | | 7/1973 | Wilkins et al. | |
| 3,807,345 | A | | 4/1974 | Peterson | |
| 3,858,477 | A | | 1/1975 | Kawakami | |
| 4,324,164 | A | | 4/1982 | Monte et al. | |
| 4,570,525 | A | | 2/1986 | Suzuki | |
| 4,619,178 | A | | 10/1986 | Kondoh | |
| 4,913,023 | A | | 4/1990 | Mizuguchi et al. | |
| 4,941,386 | A | | 7/1990 | Stevens | |
| 5,189,236 | A | | 2/1993 | Stevens | |
| 5,977,465 | A | * | 11/1999 | Piper | 84/422.4 |
| 6,151,723 | A | * | 11/2000 | MacAllister | 4/246.1 |
| 6,245,978 | B1 | * | 6/2001 | Stevens | 84/402 |
| 7,361,822 | B1 | | 4/2008 | Hsieh | |
| 7,732,691 | B2 | * | 6/2010 | Stevens et al. | 84/403 |
| 2002/0073824 | A1 | | 6/2002 | Adams | |
| 2010/0107852 | A1 | * | 5/2010 | Stevens | 84/402 |
| 2010/0192749 | A1 | * | 8/2010 | Sims | 84/410 |
| 2010/0326261 | A1 | * | 12/2010 | Stevens et al. | 84/746 |

OTHER PUBLICATIONS

"Vander Plas Percussion Discussion Board Web Pages," retrieved on Jan. 8, 2007 (pp. 1-9).

* cited by examiner

*Primary Examiner* — Elvin G Enad
*Assistant Examiner* — Robert W Horn
(74) *Attorney, Agent, or Firm* — Grossman, Tucker, Perreault & Pfleger, PLLC

(57) ABSTRACT

A keyboard percussion instrument may include an improved dampening system that provides wave dampening or progressive dampening of the tone bars. A keyboard percussion instrument may also include a dampening system with a mechanism capable of retracting the damper without distorting the damper and capable of adjusting the leverage of the dampening system independently of the spring tension. A dampening system may further include an adjustable mounting for the damper that allows the dampening action to be adjusted at either end of the damper. A keyboard percussion instrument may further include an improved bar rail assembly that facilitates removability, adjustment of various dampening zones and/or vibration isolation.

24 Claims, 6 Drawing Sheets

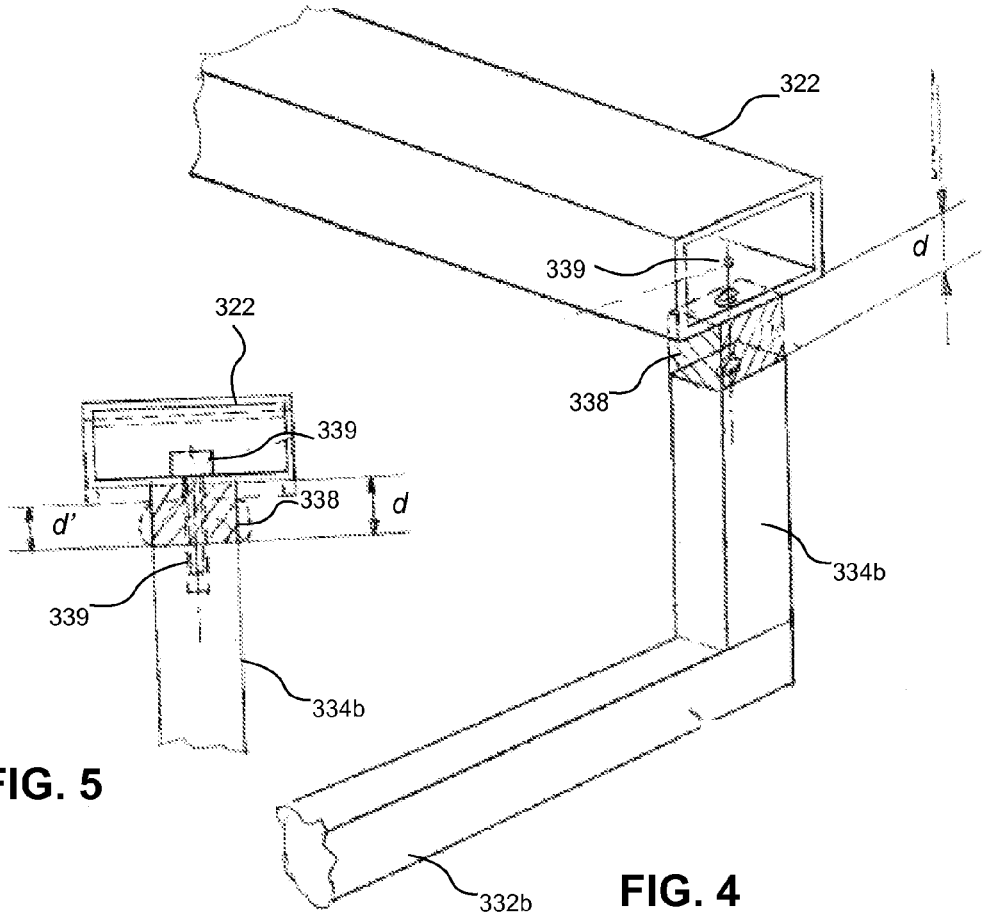
FIG. 4
FIG. 5
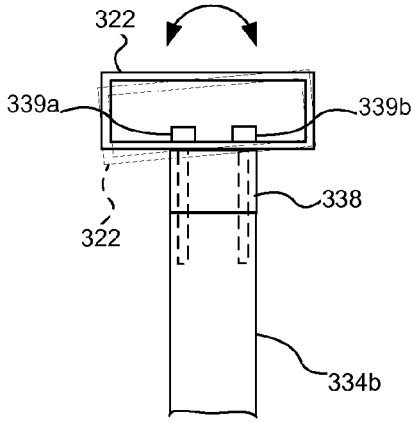
FIG. 5A

KEYBOARD PERCUSSION INSTRUMENT AND DAMPENING SYSTEM FOR USE THEREWITH

CROSS-REFERENCE TO RELATED APPLICATION

The present application claims the benefit of U.S. Provisional Patent Application Ser. No. 61/111,161, filed on Nov. 4, 2008, which is fully incorporated herein by reference.

TECHNICAL FIELD

The present invention relates to keyboard percussion instruments and more particularly, to keyboard percussion instruments with improved dampening.

BACKGROUND INFORMATION

A category of musical instruments known as keyboard percussion instruments includes marimbas, vibraphones, xylophones and glockenspiels. Referring to FIGS. 1 and 2, a keyboard percussion instrument 10 generally includes keys known as tone bars 14 that are supported on support rails 22 such that the tone bars 14 are allowed to ring freely when struck by a mallet (not shown). The tone bars 14 and support rails 22 may form a tone bar rail assembly (sometimes referred to as the "harp"). The keyboard percussion instrument may also include a frame 20 that supports the tone bar rail assembly. The keyboard percussion instrument 10 may further include resonators 15 mounted below the tone bars 14.

The keyboard percussion instrument 10 may also include a dampening system including a damper 30 to dampen the tone bars 14 and stop the ringing. The dampening system may include a pedal 34 for user actuation of the dampening. Examples of such keyboard percussion instruments are described in greater detail in U.S. Pat. Nos. 6,245,978 and 5,977,465 and in U.S. Patent Application Publication No. 2008/0105105, all of which are fully incorporated herein by reference.

The dampening systems in existing keyboard percussion instruments have suffered from various drawbacks. In particular, the dampers in these instruments often make initial contact with the tone bars at the ends of the tone bars. Some instruments use a flat felt damper that contacts the bars evenly and other instruments use a fluid-filled bladder that first contacts the ends and then swells to contact the tone bar closer to the nodes of the tone bar. Because the ends of the tone bars are often a point of maximum vibration, the dampening by initial contact at these locations may result in buzzing, which does not provide a desirable musical effect.

Another drawback of existing dampening systems is the dampening of the tone bars at different locations on the instrument at different times, which also detracts from the musical quality of the instrument. In particular, the top and bottom notes often do not dampen at the same time, and the sharps and naturals often do not dampen at the same time. The middle portion of the instrument often does not dampen at the same time as the ends of the instrument because of the deformation of the damper by directly pulling on the damper with the user actuation mechanism. When the damper is deformed by the force applied to the damper, for example, a dampening surface of the damper may not contact the tone bars evenly.

In existing keyboard percussion instruments, the feel of the damper system (i.e., the pedal resistance) cannot easily be adjusted. In some existing instruments, the only way to adjust the pedal resistance or response is to adjust the spring tension of the dampening system. Such adjustments to the spring tension of the pedal simultaneously and indiscriminately affect the dampening balance. Other instruments merely adjust the angle of pull, which may not improve the feel, leverage, and control of the damper system by the musician.

A further drawback of existing keyboard percussion instruments relates to the mounting of the support rails to the frame of the instrument. The existing instruments do not allow the tone bar support rails or entire harp to be removed or adjusted. The existing instruments also do not adequately prevent transmission of noise to the instrument frame and/or resonators from the impact of the mallets upon the tone bars.

BRIEF DESCRIPTION OF THE DRAWINGS

These and other features and advantages will be better understood by reading the following detailed description, taken together with the drawings wherein:

FIG. 4 is a perspective view of a damper bar mounted to a pivot arm in a dampening system, consistent with an embodiment.

FIG. 5 is a side view of the damper bar adjustably mounted to a damper support extending from a pivot arm, consistent with an embodiment.

FIG. 5A is a side view of the damper bar adjustably mounted to rotate along a longitudinal axis, consistent with another embodiment

DETAILED DESCRIPTION

Keyboard percussion instruments, consistent with embodiments described herein, may include an improved dampening system and/or an improved tone bar rail assembly mounting. Embodiments of improved dampening systems described herein may improve dampening of tone bars on the keyboard in one or more different ways. One embodiment of a dampening system may provide wave dampening or progressive dampening of the tone bars. Another embodiment of a dampening system may include a mechanism capable of applying and retracting the damper without distorting the damper and capable of adjusting the leverage of the dampening system. A further embodiment of a dampening system may include an adjustable mounting for the damper that allows the dampening action to be adjusted at either end of the damper. Embodiments of improved bar rail assemblies described herein facilitate quick assembly for travel, fine adjustment of the tone bars to the damper, and/or vibration shock isolation of the frame and resonators from the tone bars.

Figure 1:
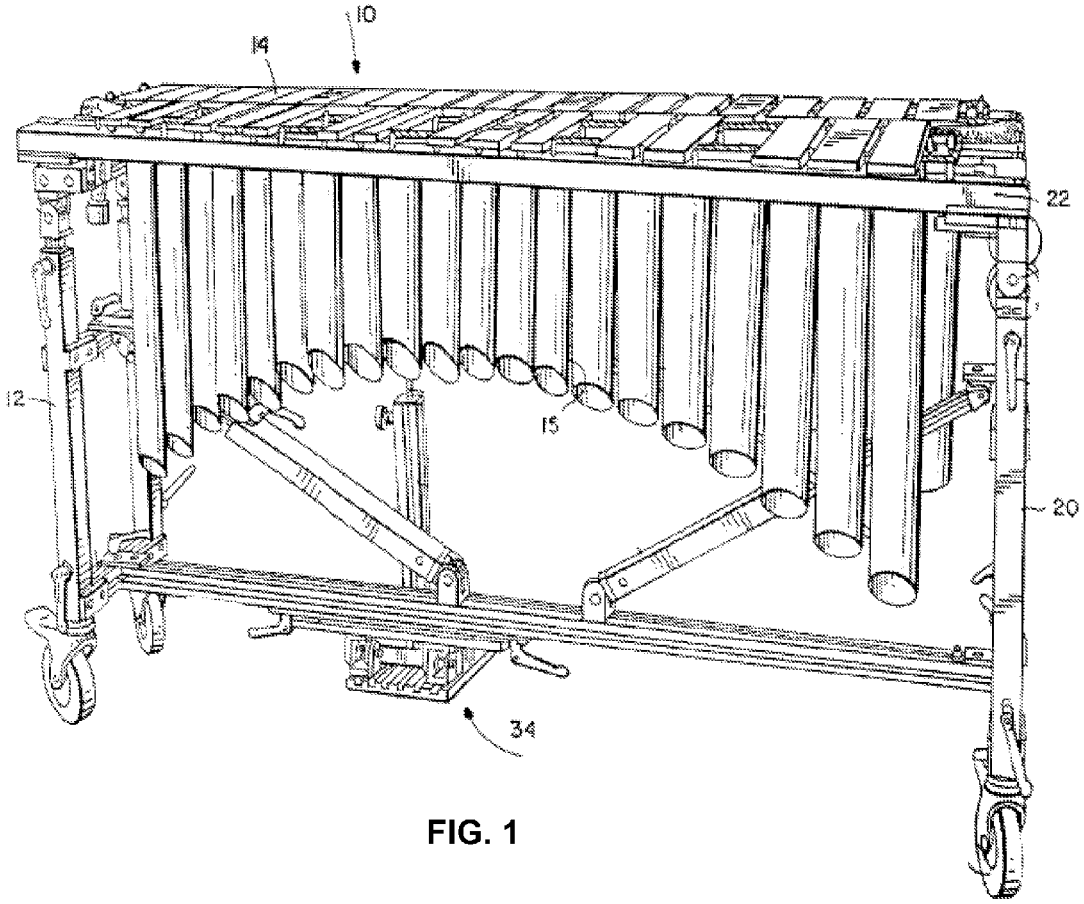
FIG. 1 is a perspective view of a keyboard percussion instrument.
Figure 2:
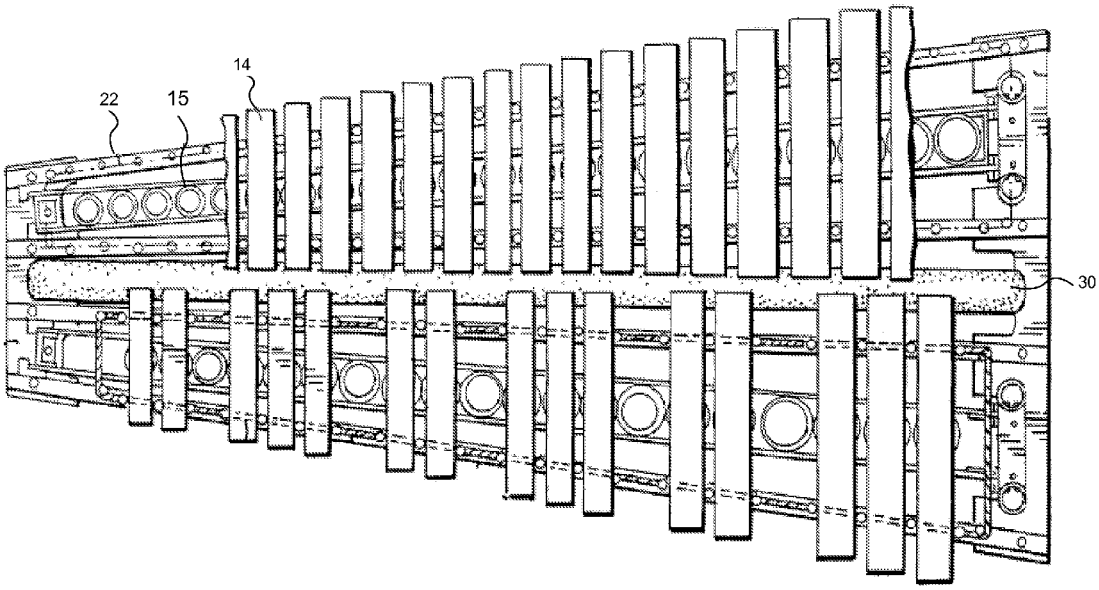
FIG. 2 is a top view of a keyboard percussion instrument.
Figure 3:
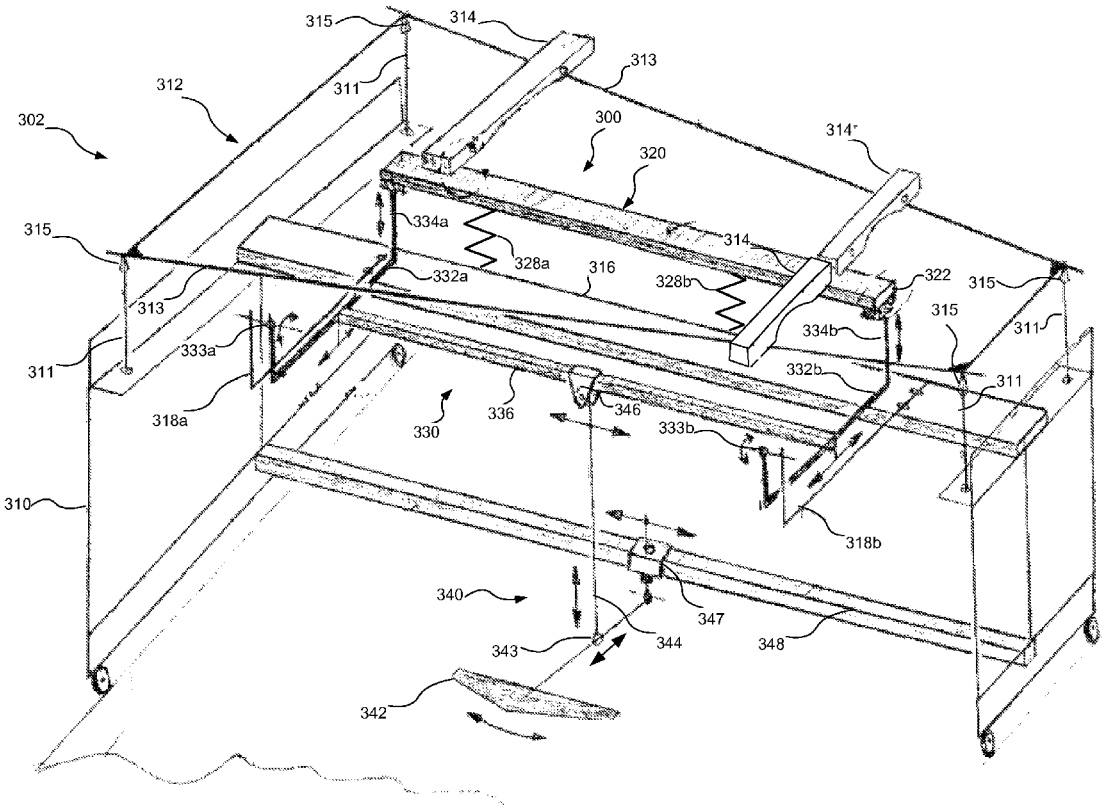
FIG. 3 is a schematic perspective view of a keyboard percussion instrument including a dampening system, consistent with an embodiment.

Referring to FIG. 3, a dampening system 300 for use in a keyboard percussion instrument 302 is shown in greater detail. As shown schematically, the keyboard percussion instrument 302 includes a support frame 310 that supports a harp or tone bar support rail assembly 312, as will be described in greater detail below. The bar support rail assembly 312 includes support rails 313 supporting tone bars 314. The tone bars 314 may be supported directly on support rails 313 or on some element (not shown) that extends from or is supported by the support rails 313. Although only three tone bars 314 are shown in this schematic illustration, the keyboard percussion instrument 302 generally includes a full set of tone bars 314 (i.e. including sharps and naturals).

The dampening system 300 generally includes a damper 320 for engaging the tone bars 314 to dampen vibrations thereof and a damper moving mechanism 330 for moving the damper 320 into and/or out of engagement with the tone bars 314. The damper 320 may include a damper bar 322 extending transversely relative to the tone bars 314 and having a dampening surface that contacts the tone bars 314, as will be described in greater detail below.

According to one embodiment, the damper bar 322 is maintained in contact with the tone bars 314 in a dampening position and the damper moving mechanism 330 retracts the damper bar 322. The damper bar 322 may be maintained in contact with the tone bars 314 using one or more springs 328*a*, 328*b* or other biasing mechanisms. The damper moving mechanism 330 may include pivot arms 332*a*, 332*b* pivotably coupled, for example, to the frame 310. One embodiment of the frame 310 may include a cross supporting member or bar 316 and pivot arm supports 318*a*, 318*b* extending from the cross bar 316 and pivotably supporting the pivot arms 332*a*, 332*b*. Damper supports 334*a*, 334*b* extend from the pivot arms 332*a*, 332*b* and the damper bar 322 is mounted at each end to the damper supports 334*a*, 334*b*, as will be described in greater detail below. The spring(s) 328*a*, 328*b* (or other biasing mechanism) may be mounted between the cross bar 316 and the damper bar 322.

Although the illustrated damper moving mechanism 330 includes first and second pivot arms, a damper moving mechanism may also include only a single pivot arm or more than two pivot arms. In other embodiments, the damper moving mechanism may directly pull on the damper bar without using pivot arms. Other configurations for supporting the pivot arms 332*a*, 332*b* are also possible. The pivot arm supports 318*a*, 318*b* may also be mounted to the sides of the frame 310 or the pivot arms 332*a*, 332*b* may be pivotably supported directly by the frame 310.

A puller bar 336 is coupled between the pivot arms 332*a*, 332*b* and a user actuation mechanism 340 is coupled to the puller bar 336. The user actuation mechanism 340 applies a force to the puller bar 336 causing the pivot arms 332*a*, 332*b* to pivot, which causes the damper bar 322 to retract against the force of the spring(s) 328*a*, 328*b*. By pulling on the puller bar 336 and transferring the forces to the pivot arms 332*a*, 332*b* and ends of the damper bar 322 (instead of pulling directly on the damper bar), the repeated application of these retraction forces is less likely to cause warping or deformation of the damper bar 322.

The puller bar 336 may also be adjustably mounted to the pivot arms 332*a*, 332*b* at varying distances relative to the pivot points 333*a*, 333*b* of the pivot arms 332*a*, 332*b*. In one embodiment, the puller bar 336 may include clamps at the ends that slide and lock on the pivot arms 332*a*, 332*b*, for example, using thumbscrews. Adjusting the puller bar 336 allows the leverage to be adjusted without having to adjust the tension of the spring(s) 328*a*, 328*b* and therefore leaving the spring pressure of the damper 320 against the tone bars 314 unchanged. Moving the puller bar 336 closer to the damper 320 and away from the pivot points 333*a*, 333*b* provides extra leverage (i.e., less distance but easier pedal resistance) and moving the puller bar 336 closer to the pivot points 333*a*, 333*b* provides less leverage (i.e., more movement of the damper bar with less pedal motion and more pedal resistance).

Additionally or alternatively, the linkage 344 between the puller bar 336 and the pedal 342 may be adjustably mounted to the pedal 342, for example, using an adjustable coupling 343. Adjustably mounting the linkage 344 to the pedal 342 in this manner allows the feel and control of the damper system to be adjusted without having to adjust the tension of the springs 328*a*, 328*b*. Moving the connection point (i.e., the coupling 343) closer to the pivot point of the pedal 342 provides extra leverage (i.e., less distance but easier pedal resistance) and moving the connection point closer to the toe plate end of the pedal 342 provides less leverage (i.e., more movement of the damper bar with less pedal motion and more pedal resistance). Thus, the leverage may be adjusted while the spring pressure of the damper 320 against the tone bars 314 remains unchanged.

As shown in greater detail in FIGS. 4 and 5, the damper bar 322 may be mounted to the damper supports 334*a*, 334*b* with one or more elastic elements 338 positioned therebetween. The elastic elements 338 may be made of silicone or other similar material. Fastening elements 339, such as bolts, extend through at least a portion of the damper bar 322, through the elastic elements 338 and into the respective damper supports 334*a*, 334*b*. The fastening elements 339 may be loosened and tightened to adjust the distance d between the damper bar 322 and the damper supports 334*a*, 334*b* at each end of the damper bar 322, thereby adjusting the position of the damper bar 322 relative to the tone bars. The memory of the elastic elements 338 allows the damper bar 322 to move up and down while remaining flexibly attached.

The damper bar 322 may thus be adjusted at each end to adjust the dampening moment of contact of the top and bottom ranges of the instrument independently without changing the dampening pressure of the springs 328*a*, 328*b*. At the retracted distance d', for example, the damper bar 322 is farther away from the tone bars than at the extended distance d, and thus the dampening pad (not shown) will take longer to contact the tone bars when the damper bar 322 is allowed to move back to the dampening position. This adjustment is independent of the adjustment using the harp suspension system described below and independent of an adjustment of the biasing mechanism used to bias the damper toward the tone bars.

Referring to FIG. 5A, the damper bar 322 may also be mounted to the damper supports 334*a*, 334 with a rotational adjustment about a longitudinal axis. In one embodiment, first and second fastening elements 339*a*, 339*b* (e.g., first and second bolts) extend through the respective sides of the damper bar 322, through the elastic element(s) 338, and into the respective damper support 334*b*. By loosening and/or tightening the fastening elements 339*a*, 339*b*, the sides of the damper bar 322 may be independently raised and/or lowered, thereby resulting in a rotational adjustment about a longitudinal axis of the damper bar 322. The damper bar 322 may thus be adjusted at each side to rotate the damper bar 322 (e.g., toward the player or toward the audience) to adjust the moment of contact of the dampening pad (not shown) with the natural and sharp tone bars. Because the damper bar 322 travels along an arc when the pivot arms pivot, the dampening pad on the damper bar 322 may contact natural tone bars slightly before the sharp tone bars, or vice versa. The rotational adjustment allows the damper bar 322 to be made substantially square and flat to the bottoms of the bars (i.e., both the naturals and sharps) independently of how high the damper bar 322 has traveled along the arc. The rotational adjustment may be made in addition to adjusting the height of the damper bar 322 at each end to ensure that the instrument is dampening to the correct degree over the entire range of the instrument.

Figure 6A:
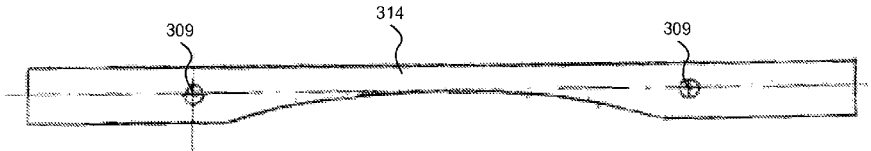
FIG. 6A is a side view of a tone bar that may be used in a keyboard percussion instrument.
Figure 6B:
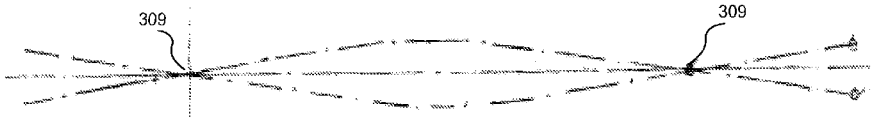
FIG. 6B is a diagram illustrating vibrations of the tone bar shown in FIG. 6A.
Figure 6C:
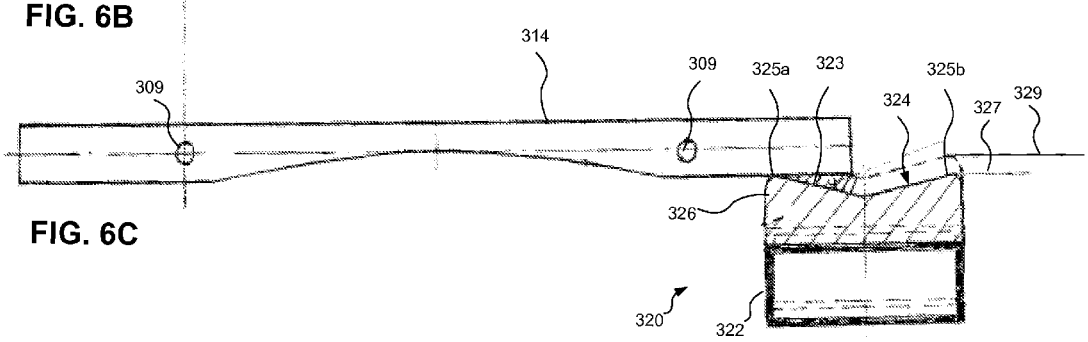
FIG. 6C is a side view of the tone bar shown in FIG. 6A with a dampening surface progressively engaging and dampening the tone bar.

As shown in FIGS. 6A-6C, the damper 320 may include a dampening element 326 with a dampening surface 324 having a shape that provides wave dampening or progressive dampening. In particular, the dampening surface 324 includes a central region 323 and one or more edges 325*a*, 325*b* that extend above the central region 323. When the dampening surface 324 contacts the tone bar 314, the edge 325*a* contacts the tone bar 314 first at a location that is closer to the non-vibrating node 309 and then the central region 323 progressively contacts the more active end of the tone bar 314 as the damper 320 moves from an initial dampening contact position 327 to a full dampening position 329. This progressive dampening reduces or eliminates the unwanted buzzing produced by the dampening material suddenly contacting the vibrating end of the tone bar 314. The tone tapers or feathers like the end of a note produced by a violin bow producing a more musical and natural end to the sound.

The dampening element 326 may be made of a soft or elastic material suitable for dampening. The dampening element 326 may include a felt pad, a soft polymer pad, or a gel-filled bladder having the dampening surface 324 with the desired shape to provide progressive dampening. One example of the material of the dampening element 326 is a soft polymer gel such as the viscoelastic gel available under the name ULTRAGEL from Soft Polymer Systems. Other types of soft elastomers (e.g., in a hardness range of 20 Shore A up to 40 Shore A) may also be used. Although the illustrated embodiment shows a V-shaped dampening surface 324, the dampening surface 324 may have other shapes such as a concave shape or a sloped shape with only one edge 325*a* extending above the central region 323. The dampening element 326 may be mounted to the damper bar 322 or the dampening element 326 and damper bar 322 may be integral or one-piece.

Although the dampening element 326 is shown contacting and dampening the single tone bar 314, the dampening element 326 similarly contacts and dampens the other tone bars in a keyboard percussion instrument. The edge 325*a* of the dampening element 326 contacts other tone bars (not shown) arranged in a side-by-side arrangement with the tone bar 314. The other side of the dampening element 326 (e.g., the other edge 325*b*) may also contact other tone bars (not shown). For example, a single dampening element 326 may contact and provide progressive dampening for both the natural tone bars and the sharp tone bars in a keyboard percussion instrument. In other embodiments, separate dampening elements 326 may be used for separate groups of tone bars such as the sharps and naturals or the high and low keys.

Referring back to FIG. 3, the user actuation mechanism 340 may include a pedal 342 and a linkage 344 coupling the pedal 342 to the puller bar 322. The linkage 344 may be a rod or cable coupled to the puller bar 322 using a slidable attachment 346, which allows the pedal 342 to be moved to different locations along the puller bar 322. The pedal 342 may also be slidably coupled to a pedal beam 348 with an attachment 347 to stabilize the pedal 342 beneath the instrument 302, which allows players to adjust for left and right foot activation and for special circumstances when it might be advantageous to have the pedal at the extreme top or bottom of the instrument. The user actuation mechanism 340 may also include a multi-function pedal controller such as the type disclosed in U.S. Provisional Patent Application Ser. No. 61/219,923, which is fully incorporated herein by reference.

According to an embodiment, the harp or bar rail assembly 312 may be removably mounted to and vibrationally isolated from the frame 310. In particular, the frame 310 may include support members 311 that extend from the frame 310 to support the support rails 313, for example, at the four corners of the bar rail assembly 312 providing a 4-point suspension system. One or more elastic members 315 may be mounted on the support members 311 and the support rails 313 may rest on the elastic members 315, as will be described in greater detail below. Thus, the entire bar rail assembly 312 may be easily removed from the instrument 302 by lifting the bar rail assembly 312 from the elastic members 315 with or without the tone bars in place.

Figure 7:
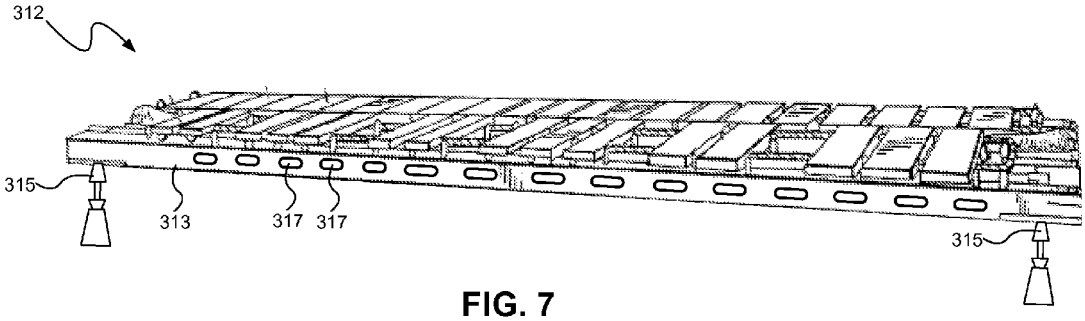
FIG. 7 is a perspective view of a removable and vibrationally isolated harp assembly for use in a keyboard percussion instrument, consistent with another embodiment.
Figure 8:
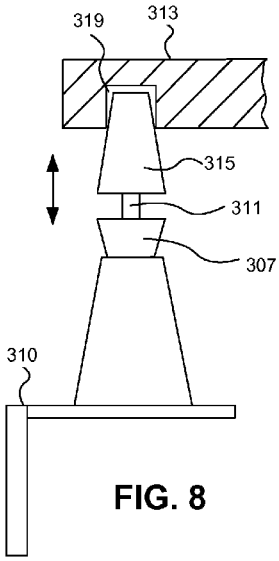
FIG. 8 is a side partially cross-sectional view of an embodiment of a support member for supporting the removable and vibrationally isolated harp assembly.

The bar rail assembly 312 is shown in greater detail in FIGS. 7 and 8. To facilitate lifting the bar rail assembly 312, the support rails 313 may include cut outs or other hollowed out regions 317 to make the assembly 312 lighter without reducing stiffness. The elastic members 315 may have a conical or frusto-conical shape that extends into support regions 319 in the support rails 313 allowing the support rails 313 to rest on the elastic members 315. The support regions 319 may be recesses extending partially through the support rails 313 (as shown) or may be holes extending completely through the support rails. The elastic members 315 may be made of silicone or other similar elastic material. The elastic material absorbs shock and prevents unwanted noise from being transmitted into the frame 310 and resonators of the instrument 302.

The support members 311 and/or the elastic members 315 may also be adjustable to different heights to allow the bar rail assembly 312 to be raised or lowered at each side or at each corner. In an embodiment, the elastic members 315 may be attached using threaded fasteners and the height of the elastic members 315 may be adjusted using the threaded fasteners. The support members 311 may be threaded, for example, into the elastic members 315 and/or into a base 307 mounted on the frame 310, thereby allowing adjustment of the height of the elastic members 315 supporting the rail assembly 312. If the high end is ringing longer than the bass, for example, the elastic members 315 may be adjusted down at the high end to make that end dampen sooner. The bar rail assembly 312 may also be adjusted to favor the natural or sharp keys by adjusting the support members 311 and/or elastic members 315 on the side closest to the player or the side closest to the audience. Although a 4-point harp suspension system with four support members 311 and elastic members 315 is shown in FIG. 3, other numbers of support members 311 and elastic members 315 may be used to support the bar rail assembly 312.

Accordingly, a keyboard percussion instrument consistent with the embodiments described herein improves the overall musicality and player control of the dampening action as well as providing the ability to adjust the moment of contact and pressure of the dampening material at various locations of the instrument and the ability to vary the leverage of the system. These adjustments may be made independent of the tension of the springs or other biasing mechanism. A keyboard percussion instrument consistent with embodiments described herein also improves vibration isolation and/or portability of the harp or bar rail assembly.

Consistent with an embodiment, a dampening system is used with a keyboard percussion instrument including a series of tone bars supported by support rails, each of the tone bars being supported at nodes. The dampening system includes a damper for engaging at least some of the tone bars and dampening vibrations thereof. The damper has a dampening surface with a central region and edges. At least one of the edges of the dampening surface extends higher than the central region such that the edge contacts the tone bars at first locations on the tone bars before the central region contacts the tone bars at second locations on the tone bars to provide progressive dampening of the tone bars. The first locations are closer to the nodes of the tone bars than the second locations. The dampening system also include a damper moving mechanism coupled to the damper for moving the damper into and/or out of engagement with the tone bars.

Consistent with another embodiment, a keyboard percussion instrument includes support rails, a series of tone bars supported by the support rails, each of the tone bars being supported at nodes, and a damper extending transversely relative to at least some of the tone bars. The damper has a dampening surface with a central region and edges, at least one of the edges of the dampening surface extending higher than the central region such that the edge contacts at least some of the tone bars at first locations on the tone bars before the central region contacts the tone bars at second locations on the tone bars to provide progressive dampening of the tone bars. The first locations are closer to the nodes than the second locations. A damper moving mechanism is coupled to the damper for moving the damper into and/or out of engagement with the tone bars.

Consistent with a further embodiment, a keyboard percussion instrument includes a support frame, support rails supported by the support frame, a series of tone bars supported by the support rails, each of the tone bars being supported at nodes, a damper extending transversely relative to the tone bars for engaging at least some of the tone bars to dampen vibrations thereof, and a damper moving mechanism for moving the damper into and/or out of engagement with the tone bars. The damper moving mechanism includes a biasing mechanism coupled to the damper for biasing the damper against the tone bars, first and second pivot arms pivotably coupled to the support frame, first and second damper supports extending from the respective pivot arms and coupled to first and second ends of the damper, a puller bar coupled to the pivot arms, and a user actuation mechanism coupled to the puller bar to apply a force causing the pivot arms to pivot and causing the damper supports to apply a force to the ends of the damper bar, which causes the damper bar to retract against a force of the biasing mechanism. The first and second damper supports are adjustably coupled to first and second ends of the damper such that the damper is adjustable relative to the tone bars.

Consistent with yet another embodiment, a keyboard percussion instrument includes a support frame, at least three support members extending from the support frame and including elastic members, a removable tone bar rail assembly removably supported on the three support members. The removable tone bar rail assembly includes support rails resting on the elastic members and a series of tone bars supported by the support rails, each of the tone bars being supported at nodes.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A dampening system for use with a keyboard percussion instrument including a series of tone bars supported by support rails, each of the tone bars being supported at nodes, the dampening system comprising:

a damper for engaging at least some of the tone bars and dampening vibrations thereof, the damper having a dampening surface with a central region and edges, at least one of the edges of the dampening surface extending higher than the central region such that the edge contacts the tone bars at first locations on the tone bars before the central region contacts the tone bars at second locations on the tone bars to provide progressive dampening of the tone bars, the first locations being closer to the nodes of the tone bars than the second locations; and a damper moving mechanism coupled to the damper for moving the damper into and/or out of engagement with the tone bars.

2. The dampening system of claim 1 wherein the dampening surface is V-shaped or concave.

3. The dampening system of claim 1 wherein the damper includes a damper bar and a dampening pad including a viscoelastic gel.

4. The dampening system of claim 2 wherein the dampening pad has a concave or V-shaped dampening surface.

5. A keyboard percussion instrument comprising:

support rails;

a series of tone bars supported by the support rails, each of the tone bars being supported at nodes;

a damper extending transversely relative to at least some of the tone bars, the damper having a dampening surface with a central region and edges, at least one of the edges of the dampening surface extending higher than the central region such that the edge contacts at least some of the tone bars at first locations on the tone bars before the central region contacts the tone bars at second locations on the tone bars providing progressive dampening of the tone bars, the first locations being closer to the nodes than the second locations; and a damper moving mechanism coupled to the damper for moving the damper into and/or out of engagement with the tone bars.

6. The keyboard percussion instrument of claim 5 wherein the damper moving mechanism comprises:

a biasing mechanism coupled to the damper for biasing the damper against the tone bars;

at least one pivot arm;

at least one damper support extending from the at least one pivot arm and coupled to the damper;

a puller bar coupled to the pivot arm; and a user actuation mechanism coupled to the puller bar to apply a force causing the pivot arm to pivot and causing the damper support to apply a force to the damper bar, which causes the damper bar to retract against a force of the biasing mechanism.

7. The keyboard percussion instrument of claim 6 wherein the puller bar is adjustable relative to a pivot point of the at least one pivot arm to adjust leverage.

8. The keyboard percussion instrument of claim 5 further comprising:

a support frame;

at least three support members extending from the support frame; and at least one elastic member mounted on the support members, wherein the support rails rest on the elastic members.

9. The keyboard percussion instrument of claim 5 further comprising:

a support frame; and at least three adjustable support members extending from the support frame for supporting the support rails and adjusting a position of the support rails relative to the support frame such that positions of the tone bars at different locations are adjustable relative to the dampening surface.

10. The keyboard percussion instrument of claim 5 wherein the damper is adjustable relative to the tone bars.

11. A keyboard percussion instrument comprising:

a support frame;

support rails supported by the support frame;

a series of tone bars supported by the support rails, each of the tone bars being supported at nodes;

a damper extending transversely relative to the tone bars for engaging at least some of the tone bars to dampen vibrations thereof; and a damper moving mechanism for moving the damper into and/or out of engagement with the tone bars, the damper moving mechanism comprising:

a biasing mechanism coupled to the damper for biasing the damper against the tone bars;

first and second pivot arms pivotably coupled to the support frame;

first and second damper supports extending from the respective pivot arms and adjustably coupled to first and second ends of the damper such that the damper is adjustable relative to the tone bars;

a puller bar coupled to the pivot arms; and a user actuation mechanism coupled to the puller bar to apply a force causing the pivot arms to pivot without pulling directly on the damper bar, which causes the damper bar to retract against a force of the biasing mechanism.

12. The keyboard percussion instrument of claim 11 wherein the first and second ends of the damper are adjustably coupled to the damper supports such that the damper is rotatable about a longitudinal axis.

13. The keyboard percussion instrument of claim 11 further comprising an elastic member mounted between the damper and the damper supports.

14. The keyboard percussion instrument of claim 11 wherein the puller bar is adjustably coupled to the pivot arms such that the puller bar is adjustable to different positions at different distances from pivot points of the pivot arms.

15. The keyboard percussion instrument of claim 11 wherein the user actuation mechanism includes a foot pedal and a linkage coupling the foot pedal to the puller bar.

16. The keyboard percussion instrument of claim 15 wherein the linkage is adjustably coupled to the foot pedal at different locations relative to a pivot point of the foot pedal to adjust leverage.

17. The keyboard percussion instrument of claim 11 further comprising:

a support frame supporting the support rails;

at least three support members extending from the support frame; and at least one elastic member mounted on the support members, wherein the support rails rest on the elastic members.

18. The keyboard percussion instrument of claim 11 wherein at least one of the support rails includes at least one hollowed out region.

19. The keyboard percussion instrument of claim 11 wherein the damper has a V-shaped or concave dampening surface.

20. A keyboard percussion instrument comprising a support frame;

at least three support members extending from the support frame and including elastic members;

a removable tone bar rail assembly removably supported on the three support members, the removable tone bar rail assembly comprising:

support rails resting on the elastic members; and a series of tone bars supported by the support rails, each of the tone bars being supported at nodes.

21. The keyboard percussion instrument of claim 20 wherein the elastic members have a conical or frusto-conical shape.

22. The keyboard percussion instrument of claim 20 wherein the elastic members are made of a soft elastomer.

23. The keyboard percussion instrument of claim 20 wherein the elastic members are adjustable to different heights relative to the support frame.

24. The keyboard percussion instrument of claim 20 wherein at least one of the support rails includes at least one hollowed out region.

* * * * *